United States Patent [19]

Rossi et al.

[11] Patent Number: 4,756,124

[45] Date of Patent: Jul. 12, 1988

[54] MACHINE FOR GRINDING THE EDGES OF A SHEET OF GLASS, PARTICULARLY FOR AUTOMOBILE WINDOWS

[75] Inventors: Pierluigi Rossi, Termoli; Dino Di Nocco, San Salvo, both of Italy

[73] Assignee: Societa' Italiana Vetro SIV S.p.A., Vasto, Italy

[21] Appl. No.: 8,586

[22] Filed: Jan. 29, 1987

[30] Foreign Application Priority Data

Feb. 4, 1986 [IT] Italy ..... 47617 A/86

[51] Int. Cl.[4] ..... B24B 9/10

[52] U.S. Cl. ..... 51/33 W; 51/97 NC; 51/105 EC; 51/165.71; 51/283 E

[58] Field of Search ..... 51/33 W, 47, 97 NC, 51/99, 101 R, 105 EC, 165.71, 165.77, 165.8, 165.85, 165.9, 165.92, 283 E

[56] References Cited

U.S. PATENT DOCUMENTS

| | | | |
|---|---|---|---|
| 3,827,189 | 8/1974 | Highberg et al. | 51/99 X |
| 4,519,167 | 5/1985 | Halberschmidt et al. | 51/165.77 |
| 4,528,780 | 7/1985 | Halberschmidt et al. | 51/165.8 |
| 4,633,408 | 12/1986 | Reinmold et al. | 51/283 E X |
| 4,648,210 | 3/1987 | Reinmold et al. | 51/165.77 |
| 4,667,443 | 5/1987 | Sakurai | 51/101 R X |

*Primary Examiner*—Robert P. Olszewski

*Attorney, Agent, or Firm*—Browdy and Neimark

[57] ABSTRACT

A machine for grinding the edge of sheets of plate glass of the type free from copying cam and controlled by an electronic system and including a grind wheel carried by a wheel arm supported on a carriage moving along a rectilinear path, is provided with a support of the wheel arm pivoted on the carriage, the angular set of which is controlled by the electronic processor so as to maintain the axis of rotation of the grind wheel on a path parallel to the path of the carriage, in order to eliminate working defects on the corners or on points of low radius of the sheet of glass (FIG. 2).

4 Claims, 4 Drawing Sheets

MACHINE FOR GRINDING THE EDGES OF A SHEET OF GLASS, PARTICULARLY FOR AUTOMOBILE WINDOWS

BACKGROUND OF THE INVENTION

1. Field of the Invention

The present invention relates to an improved machine for grinding the edges of sheets of plate glass, particularly for use in automobile windows.

It is well known that a sheet of glass which has been cut according to a desired profile, has to be ground at the edges, both to eliminate the cutting edge which otherwise could produce disadvantages during further working, and to remove possible peripheral micro-cracks which would cause breakage of the glass itself during the course of subsequent thermal treatment such as (tempering, bending, and the like.

The term grinding is used to define the operation which allows removal, by means of a diamond wheel, of a thickness of material located on the edge of the sheet for a depth which varies as a function of the use for which the sheet is intended.

2. Description of the Prior Art

Machines for grinding sheets of glass are already known from the prior art.

For example a type of apparatus used industrially is known in which the glass rotates around an axis of rotation around which also rotates a cam which is shaped like the glass. A follower wheel engages with the profile of the cam to regulate the position of the grind wheel with respect to the glass. This grinding system is commonly known as cam grinding. Examples of these machines are illustrated in U.S. Pat. Nos. 2,561,929 and 2,293,828, as well as published Italian application No. 19366A/79.

In all the machines illustrated in the above patents, it should be noted that the distance between the pivot point of the wheel arm and the axis of the shaft supporting the glass is fixed.

In French Pat. No. 2070521, which illustrates a manually controlled machine for processing profiles of sheets of glass at the artisan level, the distance between the axis of rotation of the wheel arm and the axis of the shaft supporting the glass is variable and, moreover the support of the wheel arm moves in a complex fashion, in any case not rectilinear with respect to the chassis.

U.S. Pat. No. 4,587,764 describes a grinding machine which does not use a copying cam, and uses instead an electronic control system which allows adjustment of the grinding parameters such as pressure and peripheral grinding speed, so as to obtain both the advantages of eliminating the copying cam and of obtaining a high working quality. This machine makes use of the combination of three mechanical motions: a rotational motion of the piece to be processed which defines the grinding speed, a rotational motion of the wheel arm about its pivot point which defines the grinding pressure, and a reciprocating linear motion of the pivot point itself in the horizontal direction, as a function of the shape of the piece being worked.

It has been noted in practical use that the above described system, while representing a considerable improvement with respect to the known systems, has some drawbacks in the case of grinding pieces having sharp corners of a very low radius of curvature. In fact in this case it is difficult to adjust the pressure and peripheral speed which are the characteristic parameters determining the grinding quality in the corner areas, resulting in an undesired deformation of the corner itself.

SUMMARY OF THE INVENTION

An object of the present invention is to provide an improved machine for grinding edges without use of a copying cam, capable of obtaining a higher working precision on areas having sharp corners of a low radius of curvature in the work piece.

This object is fulfilled by an improvement to a machine of the type described in U.S. Pat. No. 4,587,764, wherein a fourth mechanical motion is added to the three motions there illustrated, the fourth mechanical motion being a rotational motion of a support member of the wheel arm, the support member being pivoted to the carriage by means of a journal thus being driven by the reciprocating linear motion of the carriage itself. This additional motion, which again is controlled by electronic processing, causes the machine to maintain the center of the grind wheel in all cases sliding along a horizontal axis, parallel to the reciprocating linear motion of the carriage during grinding. In such a way it is possible to ensure that the amount of time for which the grind wheel is in correspondence with the corners is exactly that desired, with no disadvantageous time increase or decrease, due to a displacement of the axis of rotation of the grind wheel from the above mentioned axis. This causes the elimination of disturbances to the grinding speed parameter which would be introduced by a relative movement of the grind wheel, with respect to the piece being worked, in a transverse direction with respect to the straight line crossing the axis of rotation of the grind wheel and the axis of rotation of the work piece.

It is consequently an object of the present invention to provide an improved machine for grinding the edge of sheets of glass, driven by digitally controlled electric motors, of the type which includes a grind wheel rotating at a fixed speed about a axis of rotation, and carried by a wheel arm supported on an horizontally reciprocating carriage, moveable as a function of the geometrical shape of the sheet to be worked along a rectilinear path fixed with respect to the sheet, the sheet being supported and rotated by a chuck having a fixed position and a variable speed of rotation which determines the grinding speed, the improvement in the machine comprising; a support of the wheel arm secured to the carriage by means of a journal bearing for a horizontal pivotable movement; a journal shaft pivotally secured to the support for a horizontal pivotal movement to said support and positioned in a horizontally offset and parallel relationship with respect to the journal bearing, the wheel arm being rigidly secured at one end thereof to the journal shaft and supporting the grind wheel at the other end; a digitally controlled torque motor to control the attitude of the support and to provide the grinding pressure, the motor being connected to the journal bearing of the support for rotating the bearing to the extent that the support orientation, defined by a straight line crossing the center of the bearing and the center of the journal shaft, is maintained constantly parallel to the tangent on the profile of the sheet of glass at the instantaneous working point; and a digitally controlled piston acting between the support and the wheel arm to control the angle between the support and the wheel arm to maintain the axis of rotation of the grind wheel constantly on a path defined by a straight line parallel to the rectilinear path of the carriage and passing through the axis of rotation of the sheet.

Furthermore, an object of the invention is an improved method for grinding the edge of sheets of glass, wherein the axis of rotation of the grind wheel is moved along a rectilinear path defined by a straight line parallel to the translational direction of the carriage and passing through the axis of rotation of the chuck.

BRIEF DESCRIPTION OF THE DRAWINGS

The present invention will be further illustrated by reference to the accompanying drawings, in which.

DESCRIPTION OF THE PREFFERED EMBODIMENT

Figure 1:
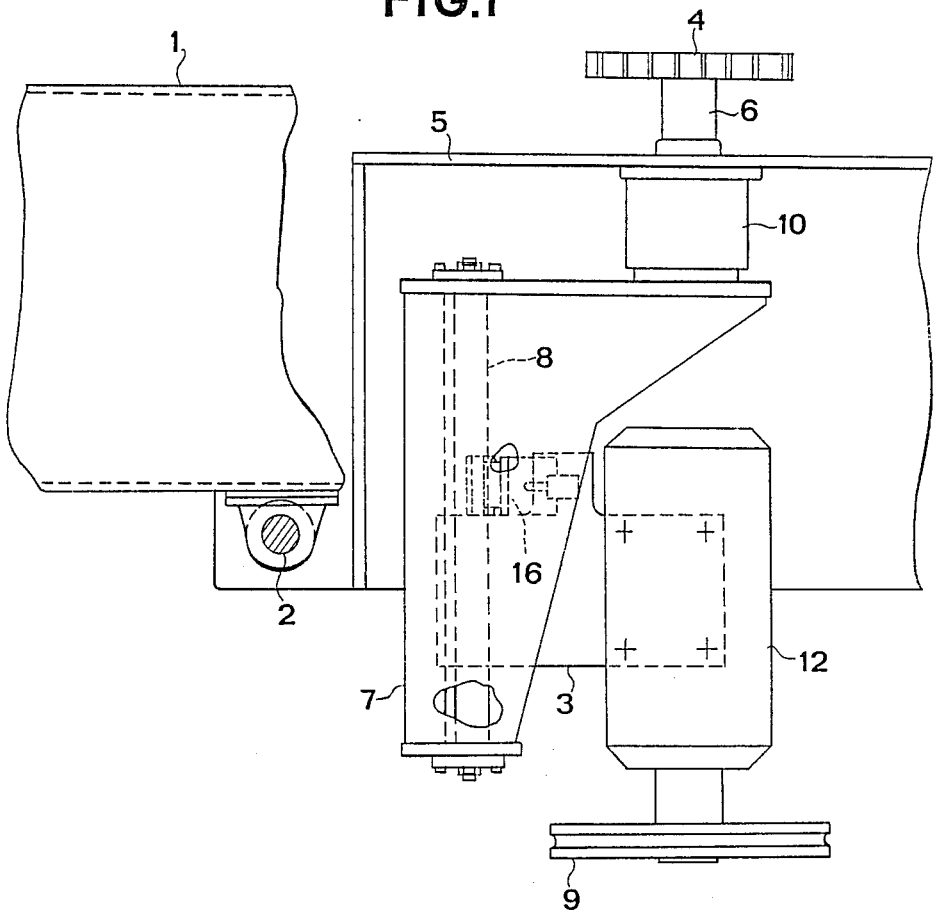
FIG. 1 shows the elements of the machine according to the invention, in the direction of arrows I—I on FIG. 3, namely with the translational direction of the carriage perpendicular to the drawing.
Figure 2:
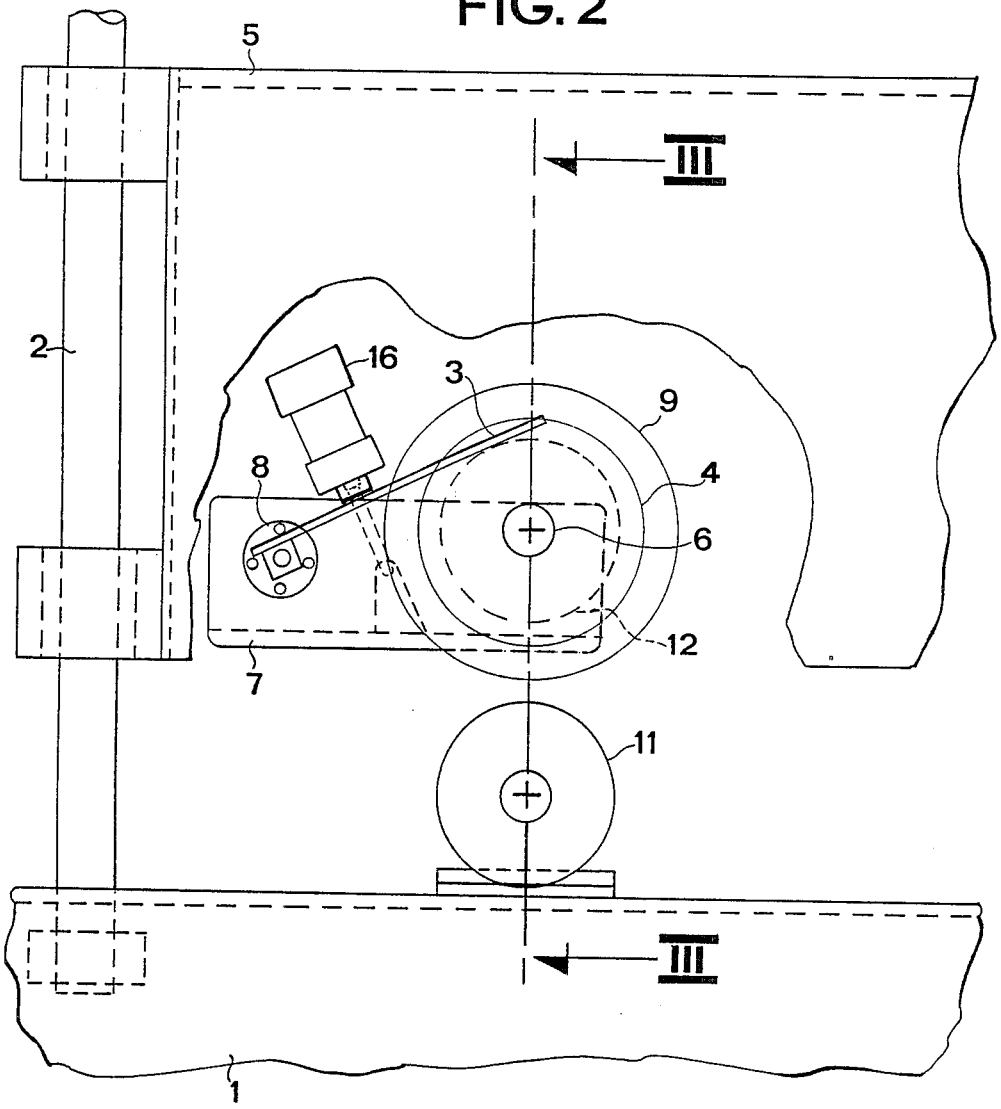
FIG. 2 is a schematical top view of the present invention.
Figure 3:
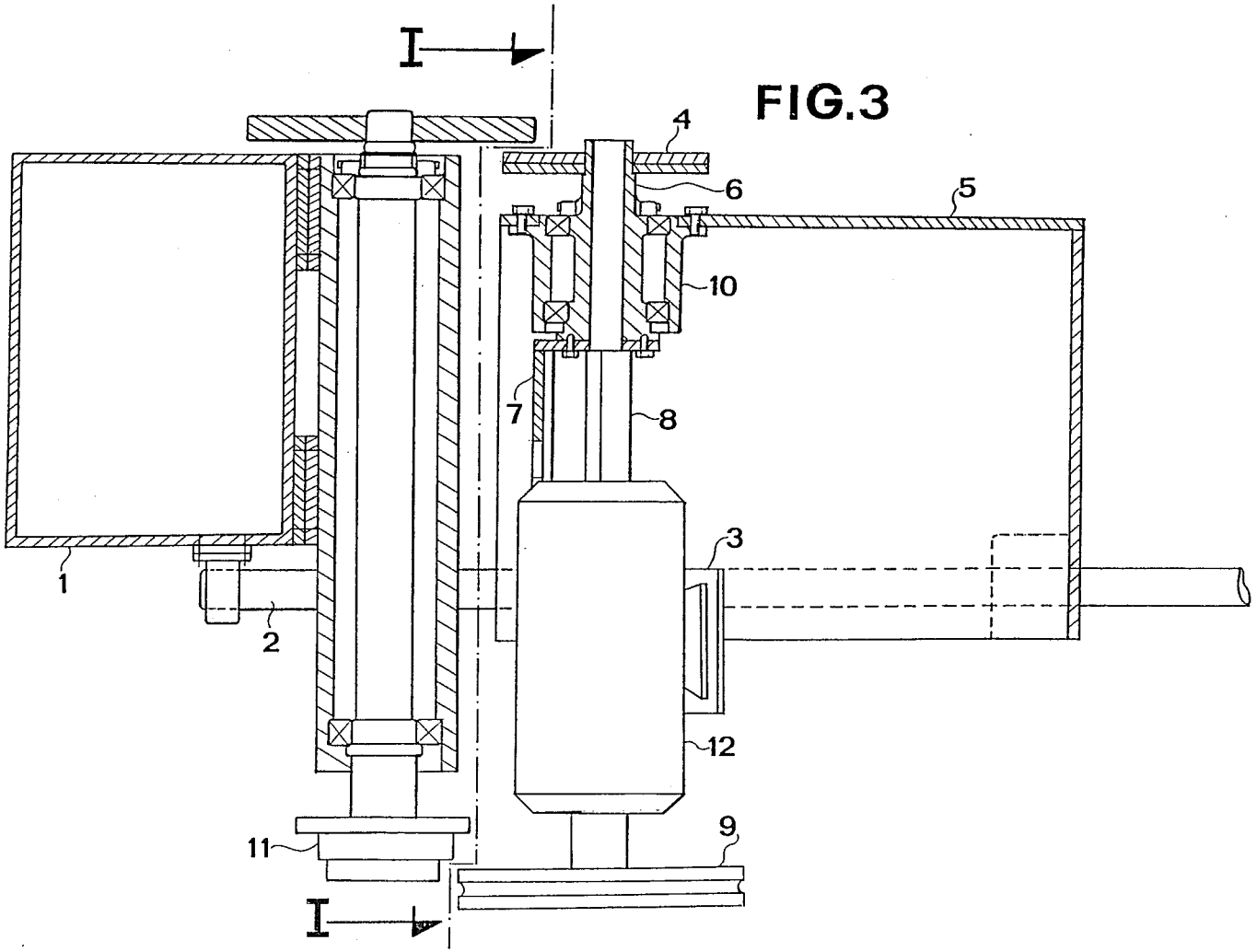
FIG. 3 is a side section view along the line III—III on FIG. 2.

Referring to FIGS. 1 to 3, the machine is based on a chassis 1 which supports slide guides 2 on which a carriage 5 slides. The carriage is moved in a reciprocating rectilinear horizontal transitional movement which serves the purpose of establishing the distance of the axis of rotation of a grind wheel 9 from the axis of rotation of a chuck 11 supporting the glass to be worked. Such elements of the machine operate as described in the U.S. Pat. No. 4,587,764 herein indicated as a reference.

As stated above, in order to eliminate the working defects in correspondence to the corners or points on the sheet of glass with a low curvature radius, it has been found necessary that the grind wheel 9 be driven by the carriage 5 without any displacement in a direction transverse to the movement of the carriage 5.

In order to obtain this result and others which will be illustrated hereinafter, the wheel arm 3 which supports the wheel mandrel 12 is driven by carriage 5 with the intermediation of a support 7, which is pivotally connected to the carriage 5 by means of a journal bearing 10. The bearing 10 comprises a shaft 6 integral with the support 7, rotatable with respect to the carriage 5 and integral with a pulley 4 which, through a belt transmission, is rotationally driven by a torque motor, not shown in the drawing. The motor adjusts the attitude or angular position of the pulley 4 and consequently of the support 7 relative to the chassis, the motor being controlled, as are the other motors of the machine, by a digital processor wherein the working parameters as well as the profile of the work piece are stored. The motor serves the additional purpose of establishing in an instant by instant mode the grinding pressure which is one of the basic working parameters, and it maintains the grind wheel 9 against the edge of the sheet of glass at the desired pressure, so as to remove the desired amount of material. The sheet is supported by and made integral with a rotating chuck 11 having a fixed axis of rotation.

On the support 7 a journal shaft 8 is pivotally secured, which in a particular embodiment is a square rod journaled at both ends to the support 7. The journal shaft 8 rigidly supports the wheel arm 3. Between the support 7 and the wheel arm 3 a pneumatic piston 16, the function of which is to control and correct the angulation between the support 7 and the wheel arm 3 acts so as to maintain the axis of rotation of the grind wheel 9 on a straight line parallel to the direction of movement of the carriage 5.

The piston 16 can be of a rolling membrane type, controlling by an electromagnetic transducer which in turn is controlled, as are the other motors of the machine, by a digital processor which establishes point by point the angulation between the support 7 and the arm 3.

Preferably, according to the present invention, the attitude of the support 7 relative to the carriage 5 is maintained parallel to the tangent at the point of the sheet of glass which is being worked by the grind wheel. By the term "attitude of the support 7", we intend a direction defined by a straight line crossing the axis of rotation of the support 7 (axis of the shaft 6) and the axis of rotation of the wheel arm 3 (axis of rotation of the journal shaft 8). The attitude of the support 7, as stated hereinbefore, is obtained by rotating the pulley 4 to such an extent that the desired attitude of the support 7 is obtained.

Preferably the combination of the movements performed by carriage 5, support 7 and wheel arm 3 is so realized that the axis of rotation of the grind wheel and the axis of rotation of the pulley 4 as well as the shaft 6, are all placed on the same vertical line. In this way the angle correction between the support 7 and the arm 3, performed by the piston 16, will always be of a small extent.

Consequently for each point on the profile of the sheet of glass to be ground, the electric motors controlled by the electronic processor will establish the working parameters, namely speed of rotation of the work piece, working pressure, distance of the center of the grind wheel 9 to the center of the chuck 11, and additionally the attitude of the support 7 and the angle correction between the support 7 and the wheel arm 3.

Figure 5:
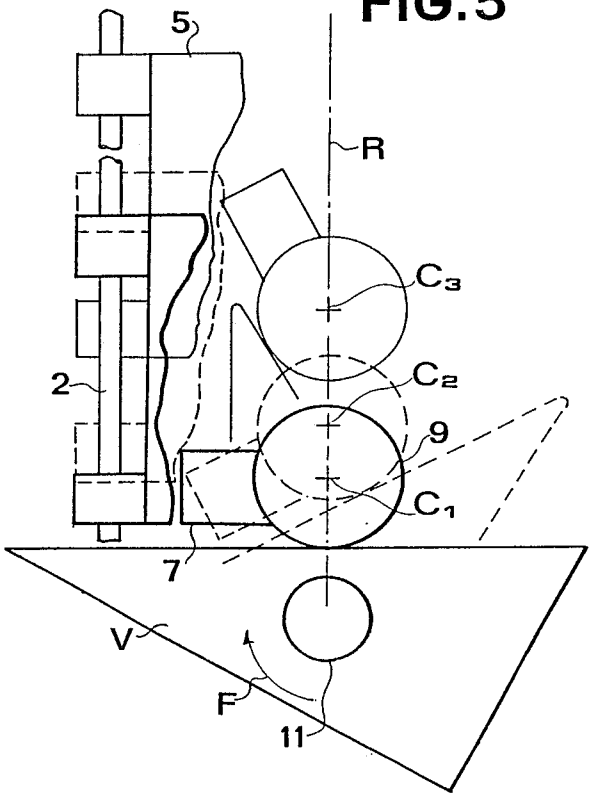
FIG. 5 is a simplified outline of the kinematical movements of the grind wheel according to the present invention.
Figure 4:
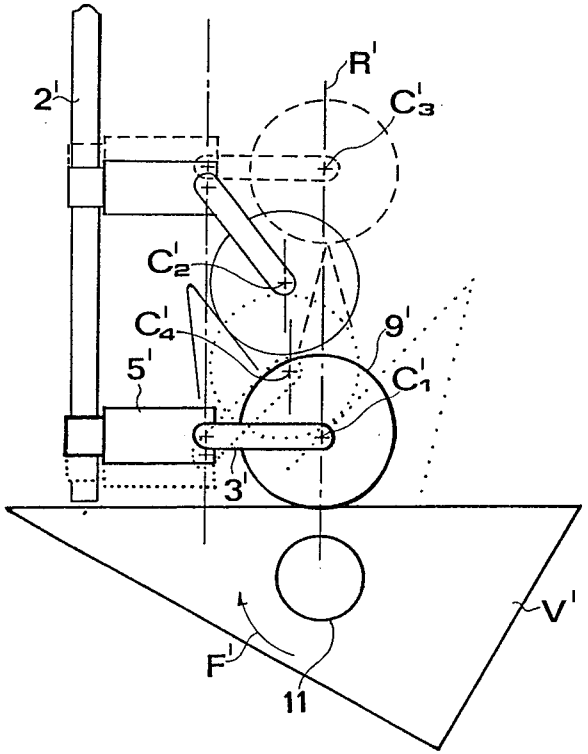
FIG. 4 is a simplified outline of the kinematical movements of the grind wheel according to the prior art.

The operation of the above illustrated machine will be better appreciated by reference to FIGS. 4 and 5.

FIG. 4 schematically illustrates the movements of a device operating according to U.S. Pat. No. 4,587,764. A piece of glass V' borne by a chuck 11, rotates in the direction of the arrow F'. In FIG. 4 there are furthermore illustrated a grind wheel 9', a wheel arm 3', a carriage 5' and a slide guide 2'. FIG. 4 illustrates four successive positions taken by the grind wheel 9' and indicated in $C'_1$, $C'_2$, $C_3$ and $C'_4$ respectively, said symbols indicating the center of the grind wheel 9' in the different positions. It can be observed that the axis of rotation of the grind wheel is continuously displaced from the translational direction R' defined by a straight line passing through the axis of rotation of the work piece and parallel to the guide 2.

Said displacement gives place to a holding time of the grind wheel on the working point in correspondence to a corner which is longer than that desired, resulting in a deformation of the corner as worked.

In fact, by observing the passage from the second to the third position, it can be seen that the axis of rotation $C'_2$ is shifted towards the direction R' until overlying thereon ($C'_3$), whereas in the successive passage the axis of rotation $C'_4$ of the grind wheel is displaced from the line R'. When bearing in mind that the speed of rotation of the grind wheel is constant, it can be observed that in this case there will be a translational speed of the grind wheel which, added to the absolute speed of the work piece, leads to a relative speed between the grind wheel and the work piece which is different from that desired for working on the point in question. In fact said desired speed should have been equal to the absolute speed of the work piece.

What happens in practice is that the grind wheel 9' will pause at the same point for a time longer than that desired, without the electronic control of the peripheral speed of the work piece being able to make it shorter.

One possible way of reducing the deformation without modifying the machine is to considerably decrease, even to zero, the grinding pressure. However, even if this pressure were zeroed, the glass corner would be pressed, during its rotational movement, by a considerable weight consisting of the weight of the grind wheel, mandrel and wheel arm, which would lead in any case to an undesireable deformation of the corner.

Turning now to FIG. 5 wherein the kinematical movements of the grind wheel according to the present invention are outlined, it can be observed that in the series of positions of the work piece V, which rotates according to the arrow F, the grind wheel 9 in all cases maintains its axis of rotation $C_1$, $C_2$, $C_3$ respectively, along the direction R passing through the axis of rotation of the work piece V and parallel to the translational direction of the carriage 5. This arrangement is obtained by reason of a support 7 of the wheel arm 3 being caused to rotate, as stated hereinbefore, so that the attitude thereof is kept parallel to the profile of the work piece.

According to the present invention, in correspondence with the corners, any transversal oscillation of the path of the axis of rotation of the grind wheel 9 is inhibited, so that said center will not be displaced from the line R as mentioned above. Consequently the holding time on the corners will be exactly that desired and set on the electronic control of the machine.

Whereas the invention has been described in a preferred embodiment, it will be appreciated that modifications thereof can be envisaged within the scope of the same invention.

What is claimed is:

1. An improved machine operated by digitally controlled electric motors for grinding the edge of a sheet of glass, including a grind wheel rotating at a fixed speed about an axis of rotation, and carried by a wheel arm supported on an horizontally reciprocating carriage, moved as a function of the geometrical shape of a sheet to be worked, along a rectilinear path fixed with respect to said sheet, said sheet being supported and rotated by a chuck having a fixed position and a variable speed of rotation which determines the grinding speed, said machine being characterized by the improvement comprising: a support for said wheel arm secured to said carriage through a journal bearing for a horizontal pivotal movement; a journal shaft secured for a horizontal pivotal movement to said support and positioned in an horizontally offset and parallel relationship with respect to said journal bearing, said wheel arm being rigidly secured at one end thereof to said journal shaft and supporting said grind wheel at the other end thereof; a digitally controlled torque motor for controlling the attitude of said support and providing the grinding pressure, said motor being connected to said journal bearing of the support for rotating said bearing to such an extent that the orientation of said support, as defined by a straight line passing through the axis of rotation of said bearing and the axis of rotation of said journal shaft, is constantly maintained parallel to the tangent on the profile of the sheet of glass at the instantaneous working point; and a digitally controlled piston acting between said support and said wheel arm for controlling the angle between the support and the wheel arm and maintaining the axis of rotation of the grind wheel constantly on a path defined by a straight line parallel to the rectilinear path of said carriage and crossing the axis of rotation of said sheet.

2. A machine according to claim 1, wherein said journal bearing comprises a shaft integral with said support and a pulley, driven by said torque motor through a belt transmission, is integral with said shaft.

3. A machine according to claim 1, wherein said pneumatic piston is a rolling membrane piston controlled by an electromagnetic transducer.

4. A machine according to claim 1, wherein the axes of rotation of said grind wheel and journal bearing are kept substantially in coincidence during working.

* * * * *